US012123263B2

(12) United States Patent
Ishizuka

(10) Patent No.: US 12,123,263 B2
(45) Date of Patent: Oct. 22, 2024

(54) MULTIDIRECTIONAL AUGER BIT

(71) Applicant: METAL TOOL INC., Aichi (JP)

(72) Inventor: Takemi Ishizuka, Nagoya (JP)

(73) Assignee: METAL TOOL INC., Aichi (JP)

( * ) Notice: Subject to any disclaimer, the term of this patent is extended or adjusted under 35 U.S.C. 154(b) by 23 days.

(21) Appl. No.: 17/993,407

(22) Filed: Nov. 23, 2022

(65) Prior Publication Data

US 2023/0091613 A1 Mar. 23, 2023

Related U.S. Application Data

(63) Continuation of application No. PCT/JP2021/036552, filed on Oct. 4, 2021.

(30) Foreign Application Priority Data

Oct. 13, 2020 (JP) ..... 2020-172348

(51) Int. Cl.
*E21B 10/44* (2006.01)
*E21B 10/58* (2006.01)

(52) U.S. Cl.
CPC ..... *E21B 10/58* (2013.01); *E21B 10/44* (2013.01)

(58) Field of Classification Search
CPC ..... E21B 10/58; E21B 10/44
See application file for complete search history.

(56) References Cited

U.S. PATENT DOCUMENTS 6,550,555 B2 * 4/2003 Huber ..... B23B 51/00 175/415
8,500,370 B2 * 8/2013 Ditillo ..... E02D 5/36 175/232
9,512,588 B2 * 12/2016 Blum ..... E02D 5/34
10,458,089 B2 * 10/2019 Wilson ..... E02D 13/00
2012/0213597 A1 * 8/2012 Baumsteiger ..... E02D 5/801 405/252.1
2016/0230469 A1 8/2016 Frost
2022/0106839 A1 * 4/2022 Ishizuka ..... E21B 10/42

FOREIGN PATENT DOCUMENTS

| | | | |
|---|---|---|---|
| JP | S5796278 | U | 6/1982 |
| JP | H169893 | U | 5/1989 |
| JP | H0716732 | A | 1/1995 |
| JP | 3085847 | U | 5/2002 |
| JP | 2002339680 | A | 11/2002 |
| JP | 2004092101 | A | 3/2004 |
| JP | 6601897 | B | 11/2019 |

OTHER PUBLICATIONS

The PCT Search Report and Written Opinion mailed on Dec. 14, 2021, for PCT Application No. PCT/JP2021/036552, 5 pages.

* cited by examiner

*Primary Examiner* — Taras P Bemko
(74) *Attorney, Agent, or Firm* — Lee & Hayes, P.C.

(57) ABSTRACT

The invention is a multidirectional auger bit mounted on an auger head, and includes a base portion having a distal end that protrudes in an axial direction of the auger head, and leg portions that is continuous with the base portion. The base portion includes a flat portion that is continuous with the leg portion, first inclined portions that are inclined from the flat portion toward a distal end side in the axial direction of the auger head, left and right side surface portions that are continuous from the first inclined portion, and a second inclined portion that is inclined from the first inclined portion toward a leg portion side in the axial direction of the auger head.

5 Claims, 5 Drawing Sheets

MULTIDIRECTIONAL AUGER BIT

This application is a Continuation Application of PCT Application No. PCT/JP2021/036552, filed Oct. 4, 2021 and based upon and claiming the benefit of priority from prior Japanese Patent Application No. 2020-172348, filed Oct. 13, 2020, the entire contents of all of which are incorporated herein by reference.

BACKGROUND OF THE INVENTION

1. Field of the Invention

The present invention relates to a multidirectional auger bit that performs simultaneous excavation in a plurality of directions with respect to an excavation surface.

2. Description of the Related Art

Conventionally, for example, in a prefabricated pile method using a pile driver, an auger head is connected to a drive mechanism and excavates a foundation hole of a building, a developed hole of a continuous underground wall body, and the like on a ground, and an auger bit provided at a distal end of the auger head is provided with a blade portion for excavation. The same applies to a steel pipe intermediate trench method and the like.

Here, for example, Patent Literature 1 (JP 2002-339680 A) discloses a detachable earth auger bit in which an excavation blade includes a central tip and side tips on both sides, and a build-up is applied to an excavation head portion. In the detachable earth auger bit, the central tip constitutes a wedge-shaped blade protruding in a curved state with respect to the side tip. As the excavation blade, an excavation blade having a self blade function in which a blade edge portion falls off according to an excavating action to regenerate a new blade edge portion is applied. The excavation blade has a rod-like tip embedded in a blade member body from a cemented carbide alloy.

BRIEF SUMMARY OF THE INVENTION

However, Patent Literature 1 just discloses the detachable earth auger bit and the earth auger having an improved detachable structure.

There is conventionally no auger bit for an auger head that is attached to an outer plate or an inner plate of a casing, or both the outer plate and the inner plate, and simultaneously excavates an excavation surface in an excavation direction and a hole wall direction, in the excavation direction and a pile core direction, or in ail the directions. Similarly, there is conventionally no auger bit that is attached to an outside of an excavating wing and simultaneously excavates an excavation surface in both an excavation direction and a hole wall direction.

The present invention has been made in view of such problems, and an object of the present invention is to provide a technique of simultaneously excavating an excavation surface in an excavation direction and a hole wall direction, in an excavation direction and a pile core direction, or in all the directions.

In order to solve the above problems, a multidirectional auger bit according to a first mode of the present invention is an auger bit mounted on an auger head, and includes a base portion having a distal end that protrudes in an axial direction of the auger head, a first cemented carbide tip protruding in an excavation direction and a second cemented carbide tip protruding in a hole wall or pile core direction are disposed at the distal end of the base portion.

A multidirectional auger bit according to a second mode of the present invention is an auger bit mounted on an auger head, and includes a base portion having a distal end that protrudes in an axial direction of the auger head, and a leg portion that is continuous with the base portion. The base portion includes a flat portion that is continuous with the leg portion, a first inclined portion that is inclined from the flat portion toward a distal end side in the axial direction of the auger head, left and right side surface portions that are continuous from the first inclined portion, and a second inclined portion that is inclined from the first inclined portion toward a leg portion side in the axial direction of the auger head. A first cemented carbide tip is disposed at the first inclined portion, the side surface portion, and the second inclined portion. A second cemented carbide tip is disposed to protrude in a direction perpendicular to the left and right side surface portions from one of the left and right side surface portions to the first inclined portion.

In the second mode, a plurality of cemented carbide tips are arranged in parallel to the axial direction of the auger head at predetermined intervals as the second cemented carbide tip.

According to the present invention, it is possible to provide a technique of simultaneously excavating an excavation surface in an excavation direction and a hole wall direction, in an excavation direction and a pile core direction, or in all the directions.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, configurations and operations of multidirectional auger bits according to first to third embodiments of the present invention will be described in detail with reference to the drawings.

The multidirectional auger bits according to the first to third embodiments of the present invention are characterized by being attached to an outer plate or an inner plate of a casing, or both the outer plate and the inner plate, and simultaneously excavating an excavation surface in an excavation direction and a hole wall direction, in an excavation direction and a pile core direction, or in all the directions. In addition, the auger bits are characterized by being attached to an outside of an excavating blade, and simultaneously excavating the excavation surface in both the excavation direction and the hole wall direction.

In order to realize the above operation, in the multidirectional auger bit, each cemented carbide tip is mounted in the excavation direction and the hole wall direction, or in the excavation direction and the pile core direction. The size, the shape, the attachment angle, and the number of the cemented carbide tips mounted in the excavation direction, the hole wall direction, and the pile core direction can be appropriately changed according to an excavation target. In addition, the hardness of the cemented carbide tip can be selected according to the excavation direction, the hole wall direction, and the pile core direction, respectively. In addition, the attachment method of the multidirectional auger bit may be either a detachable type (first and second embodiments) or a welding type (third embodiment). Hereinafter, the first to third embodiments will be described in detail.

First Embodiment

Figure 1:
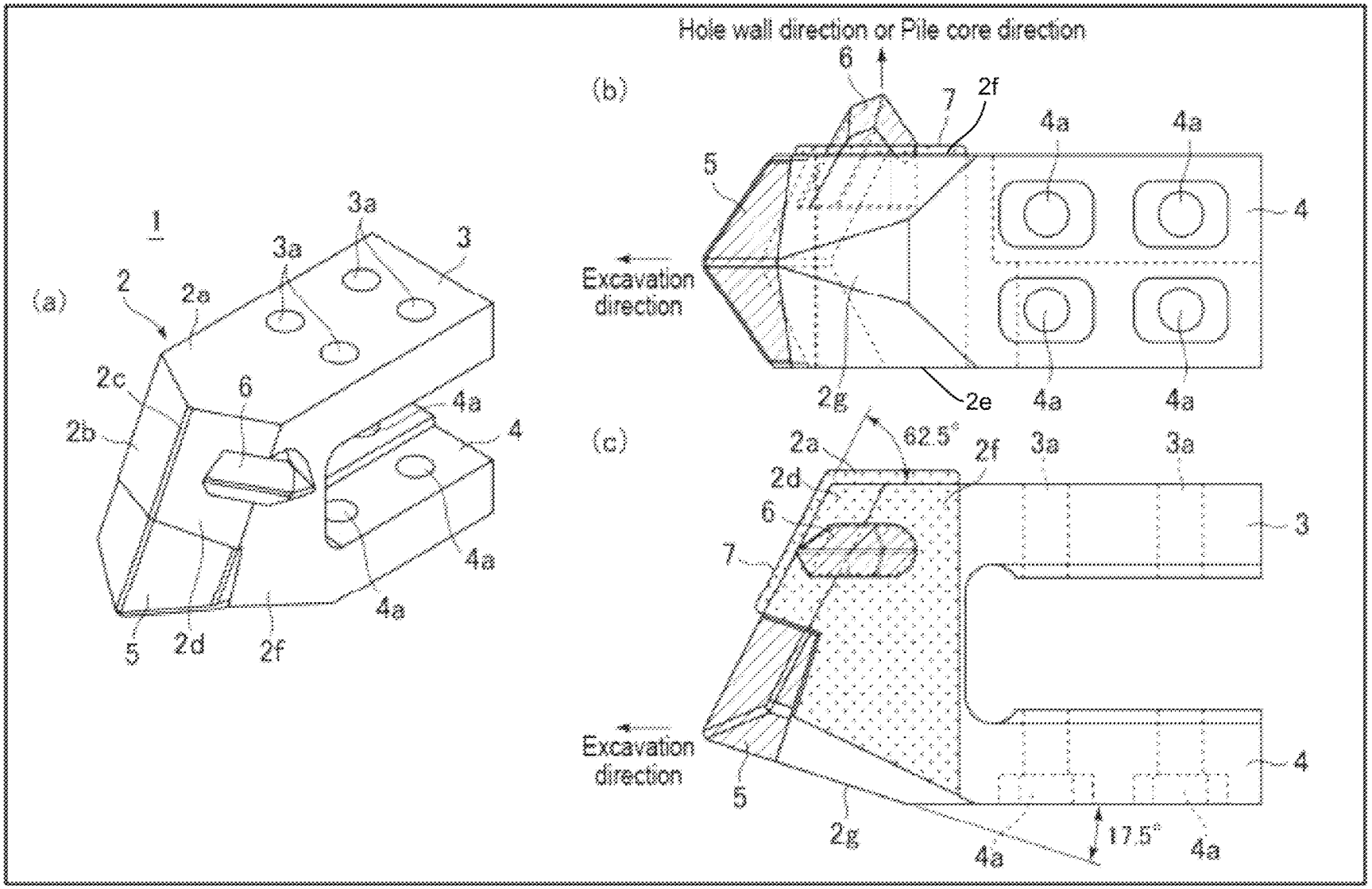
FIG. 1 is a configuration diagram of a multidirectional auger bit according to a first embodiment of the present invention.

FIG. 1 illustrates and describes a configuration of a multidirectional auger bit according to the first embodiment of the present invention More specifically, FIG. 1(*a*) is a perspective view of the auger bit, FIG. 1(*b*) is a plan view, and FIG. 1(*c*) is a side view. In FIG. 1(*a*), the illustration of a hard build-up is omitted in order to clearly show the configuration of each part.

As illustrated in the drawings, a multidirectional auger bit 1 includes a base portion 2 and two leg portions 3 and 4 extending from the base portion 2. In the first embodiment, the base portion 2 side is also referred to as a distal end of the auger bit 1, and the leg portions 3 and 4 side is also referred to as a mounting side to an auger head or a rear end of the auger bit 1. In addition, a direction in which the distal end is directed is the excavation direction, and a direction perpendicular to the excavation direction is the hole wall direction or the pile core direction.

Here, the pile core direction is the "center of a pile" in any pile construction such as a prefabricated pile, a cast-in-place pile, and a steel pipe pile used for foundation construction, and means the center portion of a casing and an excavating blade used for drawing construction of various piles, removal construction of an obstacle, and the like. On the other hand, the hole wall direction means an outer peripheral side of a pile in any pile construction such as a prefabricated pile, a cast-in-place pile, and a steel pipe pile used for foundation construction, and an outer peripheral side of a casing and an excavating blade used for drawing construction of various piles, and removal construction of an obstacle, that is, a hole wall of an underground hole constructed by excavating the ground or an obstacle.

The base portion 2 has a so-called mountain shape in which a top portion protrudes toward the distal end side of the multidirectional auger bit 1 in the axial direction of the auger head. More specifically, a flat portion 2*a* of the base portion 2 of the multidirectional auger bit 1 is parallel to flat surfaces of the leg portions 3 and 4, and three inclined portions 2*b*, 2*c*, and 2*d* inclined toward the distal end side of the auger head in the axial direction of the auger head are continuous with the flat portion 2*a* of the base portion 2.

In this example, the inclined portion 2*b* has a left end that is continuous with a side surface portion 2*e* when viewed from the distal end side of the auger head in the axial direction, and the inclined portion 2*d* has a right end that is continuous with a side surface portion 2*f* when viewed, from the distal end side of the auger head in the axial direction.

The inclined portions 2*b*, 2*c*, and 2*d* of the base portion 2 are continuous in this order in the axial direction of the auger head and a lateral direction when viewed from the distal end side, that is, a circumferential direction of the auger head. In the first embodiment example, the inclined portion 2*b* is inclined from the inclined portion 2*c* in the circumferential direction of the auger head, and the inclined portion 2*d* is inclined from the inclined portion 2*c* in the circumferential direction of the auger head (direction opposite to an inclination direction of the inclined portion 2*b*).

Lower ends of the inclined portions 2*b*, 2*c*, and 2*d* of the base portion 2 are continuous with an inclined portion 2*g*. The inclined portion 2*g* of the base portion 2 is inclined from a plane parallel to the flat portion 2*a* of the base portion 2 at 17.5 degrees toward the rear end side of the multidirectional auger bit 1, that is, the mounting side of the auger bit 1 to the auger head, in the axial direction of the auger head A hard build-up 7 is disposed on the base portion 2.

The leg portions 3 and 4 extend from the base portion 2 toward the rear end side of the auger head in the axial direction, in parallel at a predetermined interval and in a U-shape when viewed from a side surface. Four hole portions 3*a* and 4*a* are provided at the leg portions 3 and 4 in order to mount the multidirectional auger bit 1 to the auger head with bolts or the like, respectively.

In the inclined portions 2*b*, 2*c*, and 2*d* of the base portion 2 of the multidirectional auger bit 1, a first cemented carbide tip 5 is disposed below the inclined portions 2*b*, 2*c*, and 2*d*. According to the first cemented carbide tip 5, it is possible to prevent wear on the outer side of a contact surface. Further, a second cemented carbide tip 6 is provided from the inclined portion 2*d* to the side surface portion 2*f* of the base portion 2 of the multidirectional auger bit 1. The second cemented carbide tip 6 has a so-called mountain shape, and the top portion thereof faces the hole wall direction or the pile core direction. Here, the hole wall direction and the pile core direction are directions perpendicular to the excavation direction. Thus, when the multidirectional auger bit 1 is disposed on an outer plate of a casing, the second cemented carbide tip 6 faces the hole wall direction, and, when the multidirectional auger bit 1 is disposed on an inner plate, the second cemented carbide tip 6 faces the pile core direction. The material types and hardness of the first and second cemented carbide tips 5 and 6 can be freely combined according to the ground or the obstacle of the excavation target.

Here, referring to the material of each part, SCM440 (chromo steel) or the like can be adopted as a base material of the base portion 2 and the leg portions 3 and 4. As the first and second cemented carbide tips 5 and 6, E3 (material name MG30), E4 (material name MG40), E5 (material name MG50), E6 (material name MG60), end the like in JIS usage classification symbols, and G4 (CIS material type symbol VC-40), G5 (CIS material type symbol VC-50), and the like in the CIS standard can be adopted. However, the present invention is not limited to this.

As described above, according to the multidirectional auger bit in the first embodiment of the present invention, it is possible to simultaneously excavate the excavation surface in the excavation direction and the hole wall direction, in the excavation direction and the pile core direction, or in all the directions.

Second Embodiment

Figure 2:
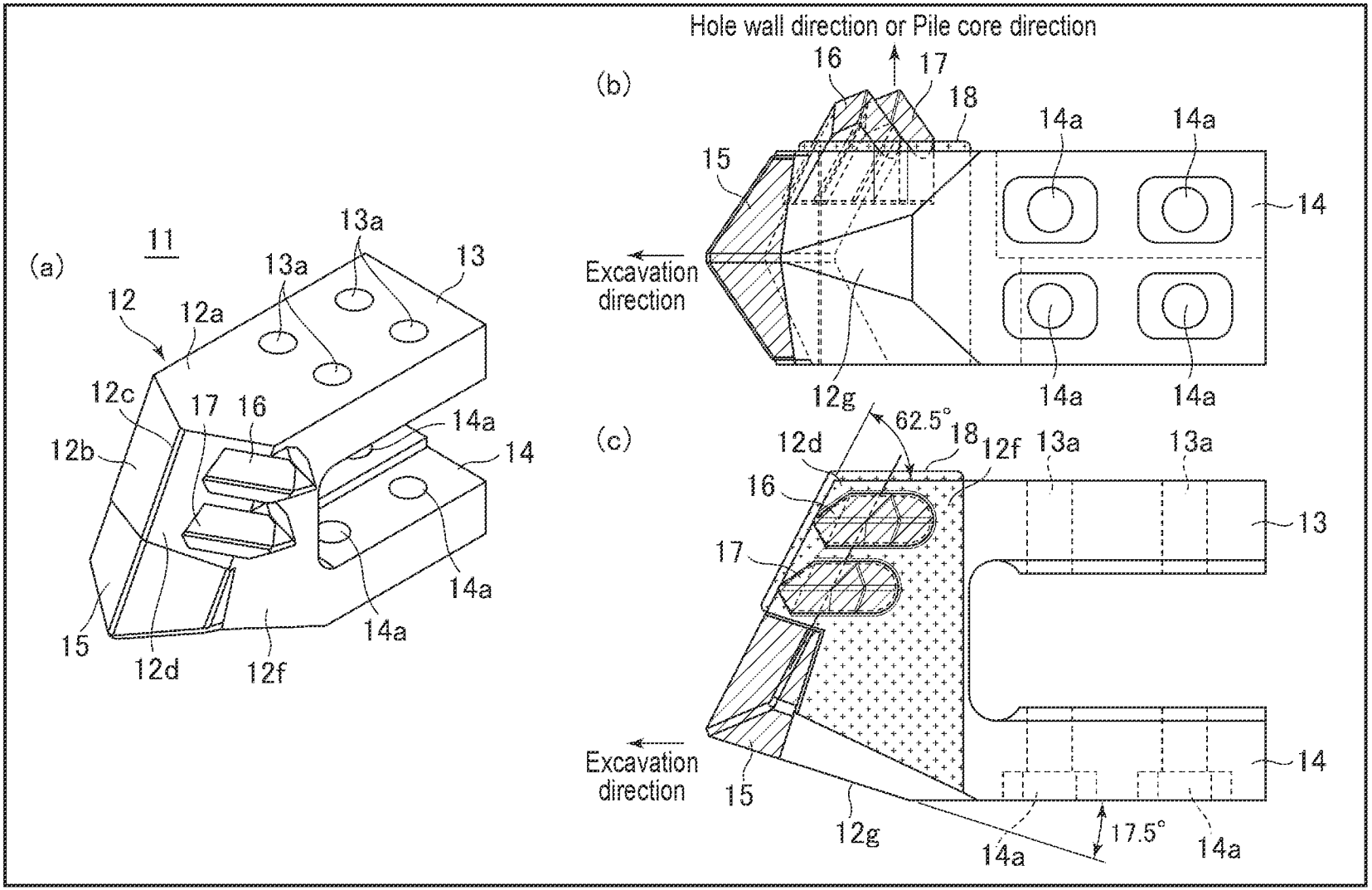
FIG. 2 is a configuration diagram of a multidirectional auger bit according to a second embodiment of the present invention.

FIG. 2 illustrates and describes a configuration of a multidirectional auger bit according to the second embodiment of the present invention More specifically, FIG. 2(*a*) is a perspective view of the auger bit, FIG. 2(*b*) is a plan view, and FIG. 2(*c*) is a side view. In FIG. 2(*a*), the illustration of a hard build-up is omitted in order to clearly show the configuration of each part.

As illustrated in the drawings, a multidirectional auger bit 11 includes a base portion 12 and two leg portions 13 and 14 extending from the base portion 12. In the second embodiment, the base portion 12 side is also referred to as a distal end of the multidirectional auger bit 11, and the leg portions 13 and 14 side is also referred to as a mounting side to an auger head or a rear end of the multidirectional auger bit 11. In addition, a direction in which the distal end is directed is the excavation direction, and a direction perpendicular to the excavation direction is the hole wall direction or the pile core direction.

The base portion 12 has a so-called mountain shape in which a top portion protrudes toward the distal end side of the multidirectional auger bit 11 in the axial direction of the auger head. More specifically, a flat portion 12*a* of the base portion 12 of the multidirectional auger bit 11 is parallel to flat surfaces of the leg portions 13 and 14, and three inclined portions 12*b*, 12*c*, and 12*d* inclined toward the distal end side of the auger head in the axial direction of the auger head are continuous with the flat portion 12*a* of the base portion 12.

In this example, the inclined portion 12*b* has a left end that is continuous with a side surface portion 12*e* when viewed from the distal end side of the auger head in the axial direction, and the inclined portion 12*d* has a right end that is continuous with a side surface portion 12*f* when viewed from the distal end side of the auger head in the axial direction.

The inclined portions 12*b*, 12*c*, and 12*d* of the base portion 12 are continuous in this order in the axial direction of the auger head and a lateral direction when viewed from the distal end side, that a circumferential direction of the auger head in the second embodiment, the inclined portion 12*b* is inclined from the inclined portion 12*c* in the circumferential direction of the auger head, and the inclined portion 12*d* is inclined from the inclined portion 12*c* in the circumferential direction of the auger head (direction opposite to an inclination direction of the inclined portion 12*b*).

Lower ends of the inclined portions 12*b*, 12*c*, and 12*d* of the base portion 12 are continuous with an inclined portion 12*g*. The inclined portion 12*g* of the base portion 12 is inclined from a plane parallel to the flat portion 12*a* of the base portion 12 at 17.5 degrees toward the rear end side of the auger bit 1, that is, the mounting side of the multidirectional auger bit 11 to the auger head, in the axial direction of the auger head. A hard build-up 18 is disposed on the base portion 12.

The leg portions 13 and 14 extend from the base portion 12 toward the rear end side of the auger head in the axial direction, in parallel at a predetermined interval and in a U-shape when viewed from a side surface. Four hole portions 13*a* and 14*a* are provided at the leg portions 13 and 14 in order to mount the multidirectional auger bit 11 to the auger head with belts or the like respectively.

In the inclined portions 12*b*, 12*c*, and 12*d* of the base portion 12 of the multidirectional auger bit 11, a first cemented carbide tip 15 is disposed below the inclined portions 12*b*, 12*c*, and 12*d*. According to the first cemented carbide tip 15, it is possible to prevent wear on the outer side of a contact surface. Further, from the inclined portion 12*d* of the base portion 12 of the multidirectional auger bit 11 to the side surface portion 12*f*, two second cemented carbide tips 16 and 17 are provided in parallel at a predetermined interval toward the rear end side in the axial direction of the auger head. The second cemented carbide tips 16 and 17 have a so-called mountain shape, and the top portion thereof faces the hole wall direction or the pile core direction. Here, the hole wall direction and the pile core direction are directions perpendicular to the excavation direction. Thus, when the multidirectional auger bit 11 is disposed on an outer plate of a casing, the second cemented carbide tips 16 and 17 face the hole wall direction, and, when the multidirectional auger bit 11 is disposed on an inner plate, the second cemented carbide tips 16 and 17 face the pile core direction. The material types and hardness of the first and second cemented carbide tips 15, 16, and 17 can be freely combined accord nq to the ground or the obstacle of the excavation target.

Here, referring to the material of each part, SCM440 (chromo steel) or the like can be adopted as a base material of the base portion 12 and the leg portions 13 and 14. As the first and second cemented carbide tips 15, 16, and 17, E3 (material name MG30), E4 (material name MG40), E5 (material name MG50), E6 (material name MG60), and the like in JIS usage classification symbols, and G4 (CIS material type symbol VC-40), G5 (CIS material type symbol VC-50), and the like in the CIS standard can be adopted. However, the present invention is not limited to this.

As described above, according to the auger bit in the second embodiment of the present invention, it is possible to simultaneously excavate the excavation surface in the excavation direction and the hole wall direction, in the excavation direction and the pile core direction, or in all the directions.

Third Embodiment

Figure 3:
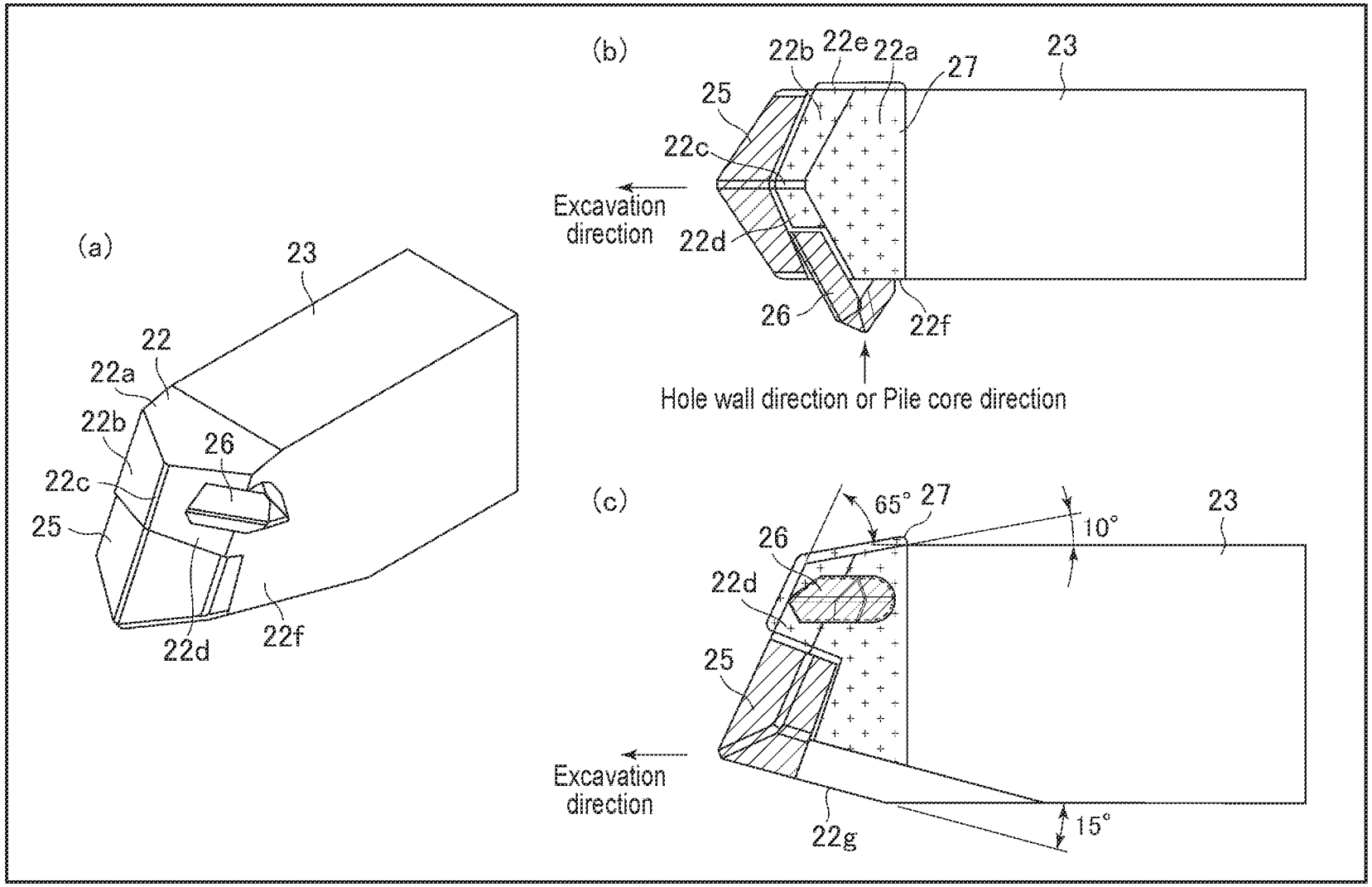
FIG. 3 is a configuration diagram of a multidirectional auger bit according to a third embodiment of the present invention.

FIG. 3 illustrates and describes a configuration of a multidirectional auger bit according to the third embodiment of the present invention. More specifically, FIG. 3(*a*) is a perspective view of the multidirectional auger bit, FIG. 3(*b*) is a plan view, and FIG. 3(*c*) is a side view. In FIG. 3(*a*), the illustration of a hard build-up is omitted in order to clearly shoe the configuration of each part.

As illustrated in the drawings, a multidirectional auger bit 21 includes a base portion 22 and a leg portion 23 (also referred to as a welding portion) extending from the base portion 22. In the first embodiment, the base portion 22 side is also referred to as a distal end of the auger bit 21, and the welding portion 23 side is also referred to as a mounting side to an auger head or a rear end of the auger bit 21. In addition, a direction in which the distal end is directed is the excavation direction, and a direction perpendicular to the excavation direction is the hole wall direction or the pile core direction.

The base portion 22 has a so-called mountain shape in which a top portion protrudes toward the distal end side of the multidirectional auger bit 21 in the axial direction of the auger head More specifically, a flat portion 22*a* of the base portion 22 of the multidirectional auger bit 21 is parallel to a flat surface of the leg portion 23, and three inclined portions 22*b*, 22*c*, and 22*d* inclined toward the distal end side of the auger head in the axial direction of the auger head are continuous with the flat portion 22*a* of the base portion 22.

In this example, the inclined portion 22*b* has a left end that is continuous with a side surface portion 22*e* when viewed from the distal end side of the auger head in the axial direction, and the inclined portion 22*d* has a right end that is continuous with a side surface portion 22*f* when viewed from the distal end side of the auger head in the axial direction.

The inclined portions 22*b*, 22*c*, and 22*d* of the base portion 22 are continuous in this order in the axial direction of the auger head and a lateral direction when viewed from the distal end side, that is, a circumferential direction of the auger head. In the third embodiment, the inclined portion 22*b* is inclined from the inclined portion 22*c* in the circumferential direction of the auger head, and the inclined portion 22*d* is inclined from the inclined portion 22*c* in the circumferential direction of the auger head (direction opposite to an inclination direction of the inclined portion 22*b*).

Lower ends of the inclined portions 22*b*, 22*c*, and 22*d* of the base portion 22 are continuous with an inclined portion 22*g*. The inclined portion 22*g* of the base portion 22 is inclined from a plane parallel to the flat portion 22*a* of the base portion 22 at 15 degrees toward the rear end side of the auger bit 21, that is, the mounting side of the auger bit 21 to the auger head, in the axial direction of the auger head. A hard build-up 27 is disposed on the base portion 22. The leg portion 23 extending in a rear end direction from the base portion 22 is a portion to be welded when the auger bit 1 is fixed to the auger head.

In the inclined portions 22*b*, 22*c*, and 22*d* of the base portion 22 of the multidirectional auger bit 21, a first cemented carbide tip 25 is disposed below the inclined portions 22*b*, 22*c*, and 22*d*. According to the first cemented carbide tip 25, it is possible to prevent wear on the outer side of a contact surface. Further, a second cemented carbide tip 26 is provided from the inclined portion 22*d* to the side surface portion 22*f* of the base portion 22 of the multidirectional auger bit 21. The second cemented carbide tip 26 has a so-called mountain shape, and the top portion thereof faces the hole wall direction or the pile core direction. Here, she hole wall direction and the pile core direction are directions perpendicular to the excavation direction. Thus, when the multidirectional auger bit 21 is disposed on an outer plate of a casing, the second cemented carbide tip 26 faces the hole wall direction, and, when the unidirectional auger bit 21 is disposed on an inner plate, the second cemented carbide tip 26 faces the pile core direction. The material types and hardness of the first and second cemented carbide tips 25 and 26 can be freely combined according to the ground or the obstacle of the excavation target.

Here, referring to the material of each part, SCM440 (chromo steel) or the like can be adopted as a base material of the base portion 22 and the leg portion 23. As the first and second cemented carbide tips 25 and 26, E3 (material name MG30), E4 (material name MG40), E5 (material name MG50), E6 (material name MG60), and the like in JIS usage classification symbols, and G4 (CIS material type symbol VC-40), G5 (CIS material type symbol VS-50), and the like in the CIS standard can be adopted. However, the present invention is not limited to this.

As described above, according to the multidirectional auger bit in the third embodiment of the present invention, it is possible to simultaneously excavate the excavation surface in the excavation direction and the bole wall direction, in the excavation direction and the pile core direction, or in all the directions.

Figure 4:
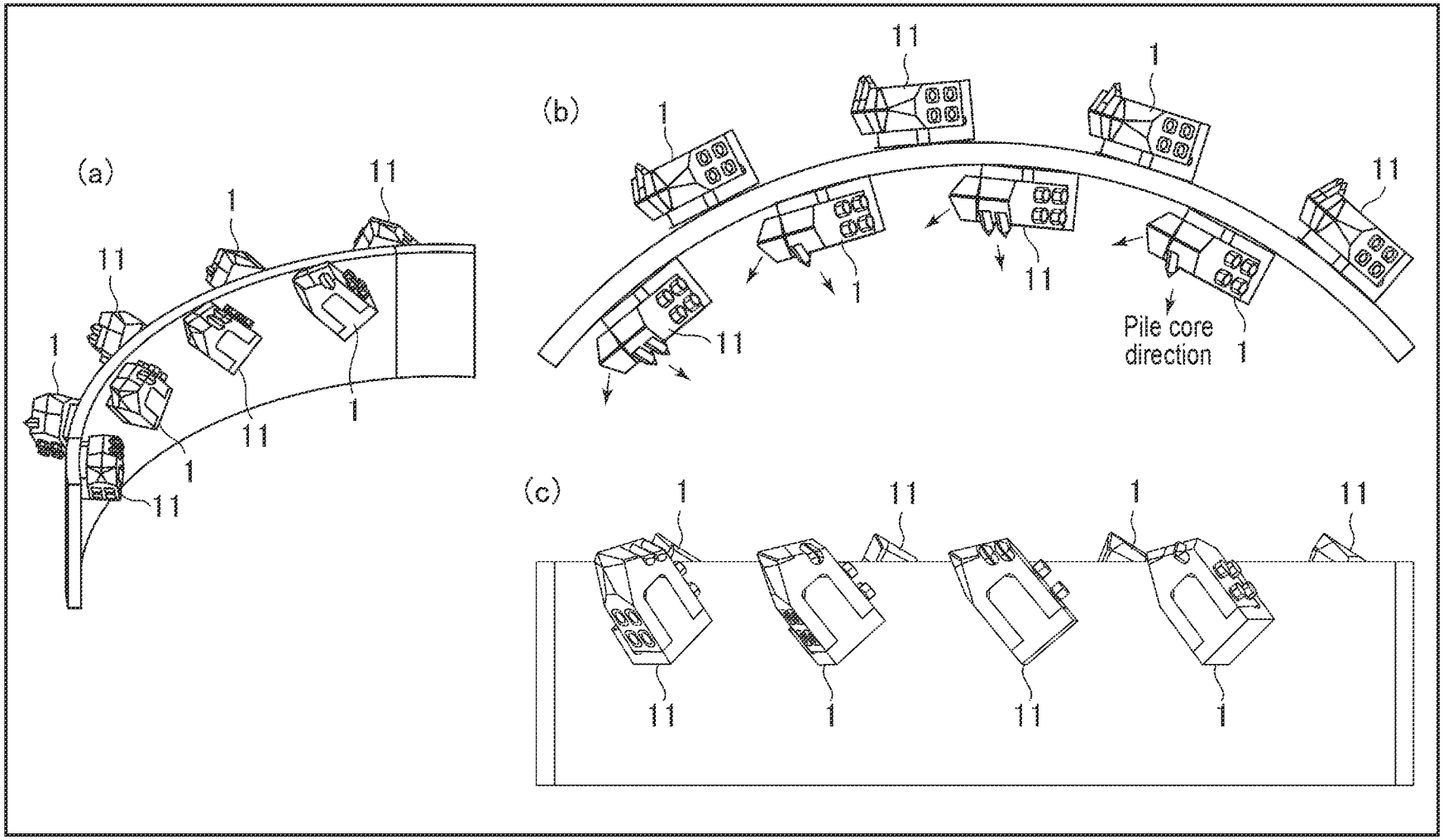
FIG. 4 illustrates a form of attachment of multidirectional auger bits.

Next, FIG. 4 illustrates a form in which first and second multidirectional auger bits of the present invention are attached to the casing, and the effects thereof will be described in detail. More specifically, FIG. 4(*a*) is a perspective view illustrating a form of attachment, FIG. 4 (*b*) is a plan view illustrating the form of attachment, and FIG. 4(*c*) is a side view illustrating the form of attachment.

As illustrated in the drawings, when the multidirectional auger bit is attached to the outer plate of the casing and used, while the first cemented carbide tip mounted in the excavation direction performs excavation in the excavation direction, the second cemented carbide tip mounted on the hole wall direction side alleviates the soil pressure and friction from a hole wall side and simultaneously increases the size of a pile diameter. The size of the pile diameter can be increased by freely changing the size of the second cemented carbide tip mounted in the hole wall direction.

Then, the second cemented carbide in mounted on the hole wall direction side assists in scraping up excavation soil excavated by the first cemented carbide tip mounted in the excavation direction from the excavation surface upward, thereby alleviating the soil pressure and friction applied to the distal end of the casing and increasing the excavation efficiency.

Furthermore, when the second cemented carbide tip mounted on the hole wall direction side excavates a hole wall, a screwing effect is given to a rotation direction side, and an excavation force increases.

In addition, in obstacle removal excavation, the second cemented carbide tip mounted in the hole wall direction excavates the outer side of the resultant obtained by excavation of the second cemented carbide tip mounted in the excavation direction. Thus, it is possible to secure a wider excavation width, and thus it is possible to perform the obstacle removal excavation in which the size is increased only by attaching the multidirectional auger bit.

By changing the number of the second cemented carbide tips to be mounted in the hole wall direction, an excavating route (path) becomes uniform. Thus, the effect of increasing the size of the pile diameter or the effect of increasing the size of an obstacle removal diameter is enhanced. For example, in the example in the drawings, second cemented carbide tips mounted in the hole wall direction are alternately attached to one multidirectional auger bit 1 and two multidirectional auger bits 11.

Furthermore, since a load applied to the outside of the casing is reduced by mounting the second cemented carbide tip on the hole wall direction side, the durability of the casing itself is increased.

On the other hand, when the auger bit is attached to the inner plate of the casing and used, while the first cemented carbide tip mounted in the excavation direction performs excavation in the excavation direction, the second cemented carbide tip mounted on the pile core direction side alleviates the soil pressure and friction from the pile core side.

Then, the second cemented carbide tip mounted on the pile core direction side assists in scraping up excavation soil excavated by the first cemented carbide tip mounted in the excavation direction from the excavation surface upward, thereby alleviating the soil pressure and friction applied to the distal end of the casing, increasing the excavation efficiency, and increasing the extraction efficiency of the excavated soil inside the casing.

Furthermore, when the second cemented carbide tip mounted on the pile core direction side excavates the inside of the casing, a screwing effect is given to a rotation direction side, and an excavation force increases.

In addition, in the obstacle removal excavation, the second cemented carbide trip mounted in the pile core direction excavates the inner side of the resultant obtained by excavation of the first cemented carbide tip mounted in the excavation direction. Thus, it is possible to secure a wider excavation width, and thus it is possible to reduce the size of the obstacle inside the casing only by attaching the auger bit, and the extraction efficiency of the obstacle inside the casing is increased. The size of the obstacle can be reduced by freely changing the size of the second cemented carbide tip mounted in the pile core direction.

By changing the number of the second cemented carbide tips to be mounted in the pile core direction, an excavating route (path) becomes uniform. Thus, the effect of extracting the excavated soil and the obstacle is further improved. For example, in the example in the drawings, tips mounted in the pile core direction are alternately attached to one multidirectional auger bit 1 and two multidirectional auger bits 11.

Furthermore, since a load applied to the inside of the casing is reduced by mounting the second cemented carbide tip on the pile core direction side, the durability of the casing itself is increased.

Figure 5:
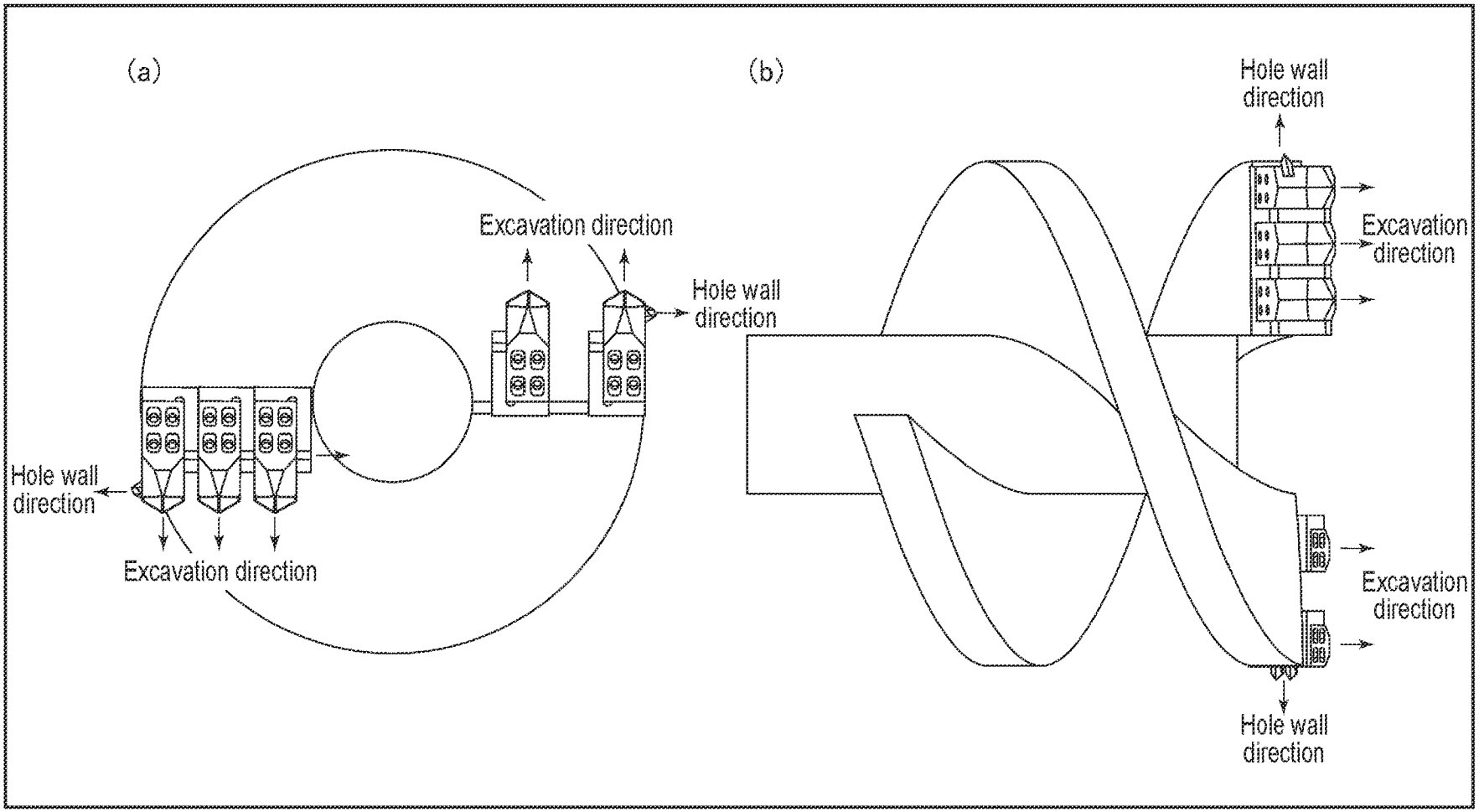
FIG. 5 illustrates a form of attachment of multidirectional auger bits.

Next, FIG. 5 illustrates a form of attachment of the first and second multidirectional auger bits of the present invention to the outside of a screw-shaped auger head (also referred to as an excavating blade), and the effect thereof will be described. FIG. 5 (*a*) is a side view illustrating the form of the attachment of the multidirectional auger bit to the auger head, and FIG. 5(*b*) is a plan view illustrating the form of the attachment of the multidirectional auger bit to the auger head.

As illustrated in the drawings, when the multidirectional auger bit is attached to the outside of the excavating blade and used, while the first cemented carbide tip mounted in the excavation direction performs excavation in the excavation direction, the second cemented carbide tip mounted on the hole wall direction side alleviates the soil pressure and friction from a hole wall side and simultaneously increases the size of the pile diameter. The size of the pile diameter can be increased by freely changing the size of the second tip mounted in the hole wall direction.

Then, when the second cemented carbide tip mounted on the hole wall direction side excavates a hole wall, the screwing effect is further given to the rotation direction side. Thus, a biting force in the excavation direction increases and the excavation efficiency increases.

Furthermore, since the first and second tips mounted in both the excavation direction and the hole wall direction simultaneously perform excavation, the amount of excavation soil scraped up by the spiral of the excavation blade increases, and the excavation efficiency is improved. By mounting the second cemented carbide tip on the hole wall direction side, it is possible to reduce the load applied to the excavating blade, so that the durability of the excavating blade itself is increased.

Although the first to third embodiments of the present invention have been described above, the present invention is not limited thereto, and various improvements and changes can be made without departing from the gist thereof.

For example, the multidirectional auger bit for a casing auger according to the present embodiment can be used for construction using, for example, a prefabricated pile method, a steel pipe intermediate trench method, or the like, and, during such construction, tipping, slipping, and wear of the cemented carbide tip are reduced as compared with the related art.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multidirectional auger bit mounted on an auger head, the multidirectional auger bit comprising:

a base portion having a distal end that protrudes in an axial direction of the auger head; and a leg portion that is continuous with the base portion, wherein the base portion includes a flat portion that is continuous with the leg portion, a first inclined portion that is inclined from the flat portion toward a distal end side in the axial direction of the auger head, a left side surface portion that is continuous from a left side of the first inclined portion, a right side surface portion that is continuous from a right side of the first inclined portion, and a second inclined portion that is inclined from the first inclined portion toward a leg portion side in the axial direction of the auger head, and a first cemented carbide tip is disposed on the first inclined portion, the left and right side surface portions, and the second inclined portion, and a second cemented carbide tip is disposed on the first inclined portion and one of the left and right side surface portions so as to protrude in a direction perpendicular to the left and right side surface portions.

2. The multidirectional auger bit according to claim 1, wherein a plurality of cemented carbide tips are arranged in parallel to the axial direction of the auger head at predetermined intervals as the second cemented carbide tip.

3. The multidirectional auger bit according to claim 1, wherein the first inclined portion includes a plurality of inclined portions inclined from the flat portion toward the distal end side, the plurality of inclined portions are continuous in a circumferential direction of the multidirectional auger bit, and the first cemented carbide tip is disposed on the plurality of inclined portions.

4. The multidirectional auger bit according to claim 1, wherein the first cemented carbide tip is disposed at the distal end side of the first inclined portion, and the second cemented carbide tip is disposed between the first cemented carbide tip and the flat portion.

5. The multidirectional auger bit according to claim 1, wherein the first cemented carbide tip is disposed so as to protrude in the axial direction of the auger head.

* * * * *